US006255919B1

(12) United States Patent
Smith

(10) Patent No.: US 6,255,919 B1
(45) Date of Patent: Jul. 3, 2001

(54) FILTER UTILIZING A COUPLING BAR

(75) Inventor: David J. Smith, Cambridge (CA)

(73) Assignee: COM DEV Limited, Cambridge (CA)

( * ) Notice: Subject to any disclaimer, the term of this patent is extended or adjusted under 35 U.S.C. 154(b) by 0 days.

(21) Appl. No.: 09/399,294

(22) Filed: Sep. 17, 1999

(51) Int. Cl.[7] ..... H01P 1/20
(52) U.S. Cl. ..... 333/202; 333/219.1
(58) Field of Search ..... 333/202, 219.1, 333/227, 230, 231, 212

(56) References Cited

U.S. PATENT DOCUMENTS

| | | | | |
|---|---|---|---|---|
| 4,692,723 | * | 9/1987 | Fiedziuszko et al. | 333/202 |
| 5,220,300 | * | 6/1993 | Snyder | 333/210 |
| 5,495,216 | | 2/1996 | Jachowski | 333/208 |
| 5,841,330 | * | 11/1998 | Wenzel et al. | 333/202 |
| 5,936,490 | | 8/1999 | Hershtig | 333/202 |
| 6,111,483 | * | 8/2000 | Haapakoski | 333/202 |

FOREIGN PATENT DOCUMENTS

| | | |
|---|---|---|
| 8700350 | 1/1987 | (WO) . |
| 9629754 | 9/1996 | (WO) . |
| 9731402 | 8/1997 | (WO) . |

* cited by examiner

*Primary Examiner*—Robert Pascal
*Assistant Examiner*—Stephen E. Jones
(74) *Attorney, Agent, or Firm*—Jones, Day, Reavis & Pogue

(57) ABSTRACT

A filter apparatus includes an enclosure defining a plurality of cavities. A pair of resonators are located in a corresponding pair of the cavities. The filter apparatus further includes an elongated coupling structure operatively interposed between the pair of resonators. The elongated coupling structure is spaced from each of those resonators uniformly along its length.

19 Claims, 3 Drawing Sheets

FILTER UTILIZING A COUPLING BAR

BACKGROUND OF THE INVENTION

The present invention relates to a electromagnetic filter that uses coupling devices to transmit an electromagnetic wave from the filter input to the filter output through a plurality of resonator cavities.

A bandpass filter passes frequencies falling within a specified band of frequencies. A microwave resonator filter is a particular type of bandpass filter that is used in communications systems on Earth and in space. Such systems include cellular, PCS, and satellite systems. Microwave resonator filters are particularly useful in spaced-based applications where the mass, volume, and electrical performance of the filter are of critical importance.

A prior art microwave resonator filter 10 is shown schematically in FIG. 1–3. The filter 10 includes an enclosure structure 12 which defines first and second cavities 14 and 16. The cavities 14 and 16 contain first and second resonators 18 and 20, respectively.

An electromagnetic ("EM") wave is received by the filter 10 through an input device 22 which is coupled to the first resonator 18. The EM wave is transmitted to the second resonator 20 through a coupling member 24, and is transmitted from the filter 10 by an output device 26, which is coupled to the second resonator 20. The structure of the cavities 14, 16, the resonators 18, 20, and the coupling member 24 affect the frequency response of the filter 10, as is known in this art.

The enclosure 12 includes a peripheral outer wall 28, an inner wall 30, a base wall 32 and a removable closure wall 34. The inner wall 30 is shorter than the outer wall 28 such that a gap 35 (FIG. 2) is defined between the inner wall 30 and the closure wall 34. As shown in FIG. 3, the coupling member 24 is a wire surrounded by an insulating material 36. A holding device 38 holds the coupling member 24 beneath the closure wall 34 in a position extending longitudinally between the two cavities 14 and 16 through the gap 35. The positioning of the coupling member 24 affects the transmission of the electromagnetic wave between the resonators 18 and 20 in the cavities 14 and 16. Therefore, the coupling element 24 must be positioned precisely relative to the resonators 18 and 20.

SUMMARY OF THE INVENTION

In accordance with the present invention, a cavity filter apparatus includes an enclosure defining a plurality of cavities. A pair of resonators are located in a corresponding pair of the cavities. The apparatus further includes an elongated coupling structure operatively interposed between the pair of resonators. The elongated coupling structure is spaced from each of those resonators uniformly along its length.

In a preferred embodiment of the invention, the enclosure includes an outer wall structure surrounding the cavities and an inner wall structure separating the cavities. The coupling structure comprises a rigid electrically conductive bar, such as Aluminum or Invar, projecting longitudinally from the outer wall structure. The bar is located directly above an upper edge surface of the inner wail structure between the pair of cavities in which the resonators are located.

BRIEF DESCRIPTION OF THE DRAWINGS

The present invention will be apparent in those skilled in the art in view of the accompanying drawings, wherein.

DESCRIPTION OF PREFERRED EMBODIMENTS

Figure 1:
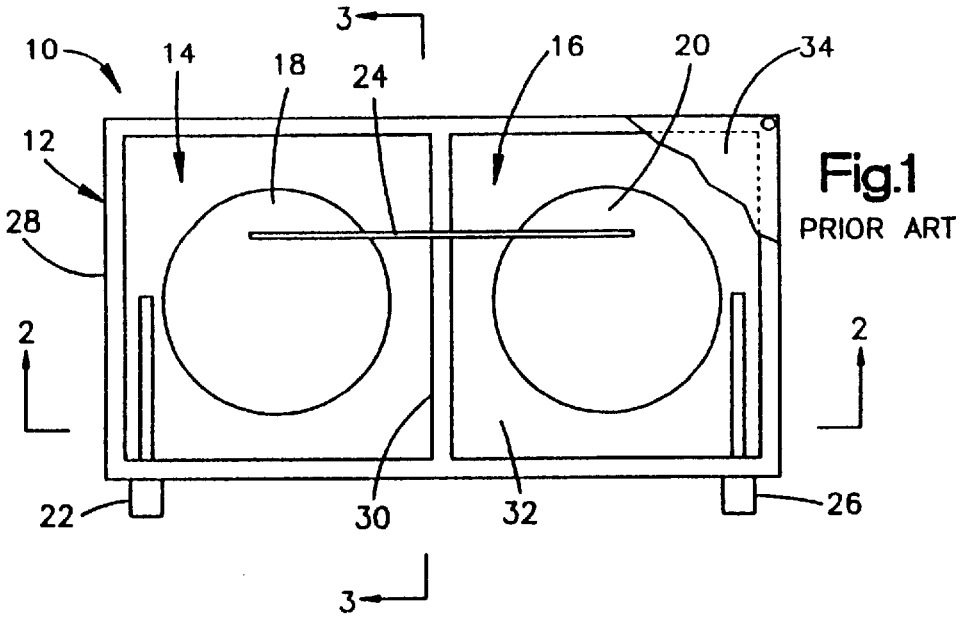
Fig.1 PRIOR ART
FIG. 1 is a top view of a prior art microwave resonator filter.
Figure 2:
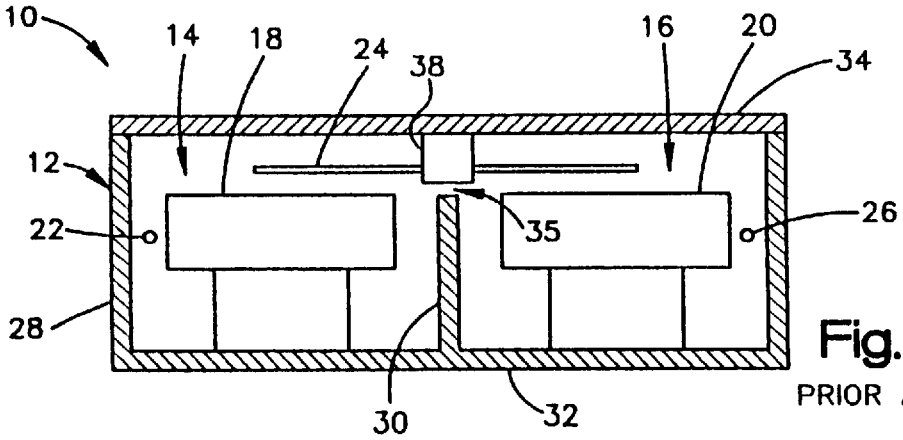
Fig.2 PRIOR ART
FIG. 2 is a view taken on line 2—2 of FIG. 1.
Figure 3:
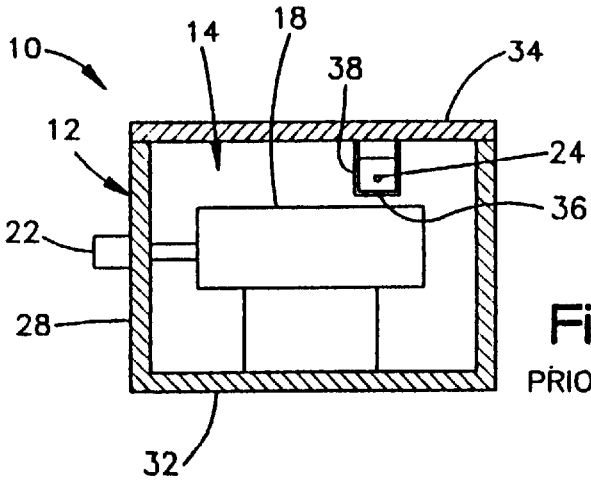
Fig.3 PRIOR ART
FIG. 3 is a view taken on line 3—3 of FIG. 1.
Figure 4:
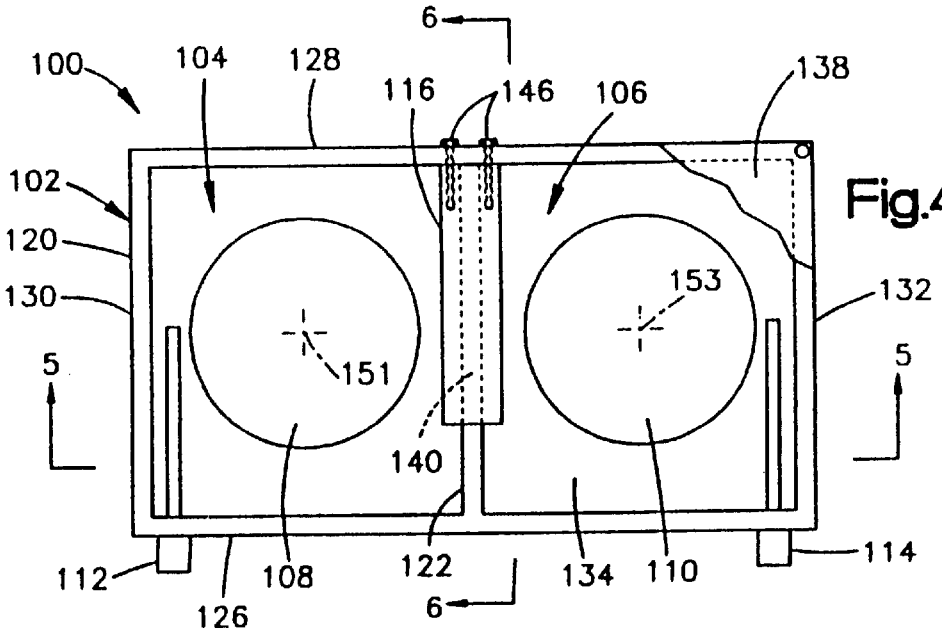
FIG. 4 is a top view of a filter comprising a first embodiment of the invention.

A cavity filter 100 comprising a first embodiment of the present invention is shown in FIG. 4. The filter 100 is preferably a microwave resonator filter including an enclosure 102 which defines first and second cavities 104 and 106. First and second resonators 108 and 110 are contained in the first and second cavities 104 and 106, respectively. The filter 100 further includes input and output devices 112 and 114 for receiving and transmitting an electromagnetic wave. The wave is filtered upon passing through the resonators 108 and 110 in the cavities 104 and 106. In accordance with the invention, the resonators 108 and 110 in the cavities 104 and 106 are coupled through the use of a coupling structure 116 which is located between the cavities 104 and 106.

The enclosure 102 includes a peripheral outer wall structure 120 surrounding the cavities 104 and 106, and further includes an inner wall structure 122 separating the cavities 104 and 106. The outer wall structure 120 in the first embodiment has a rectangular configuration defined by a front wall 126, a rear wall 128, and a pair of opposite end walls 130 and 132. The input and output devices 112 and 114 are mounted on the front wall 126 near opposite ends of the front wall 126.

Figure 5:
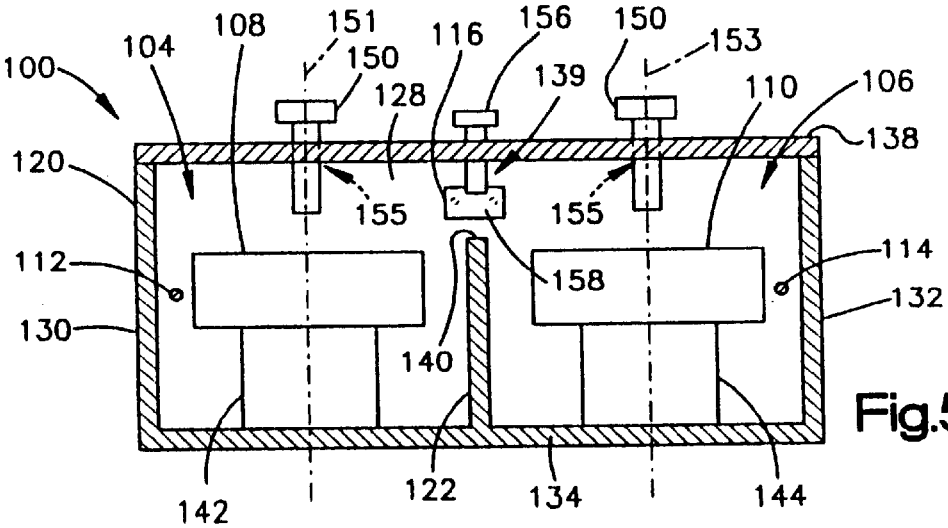
FIG. 5 is a view taken on line 5—5 of FIG. 4.
Figure 6:
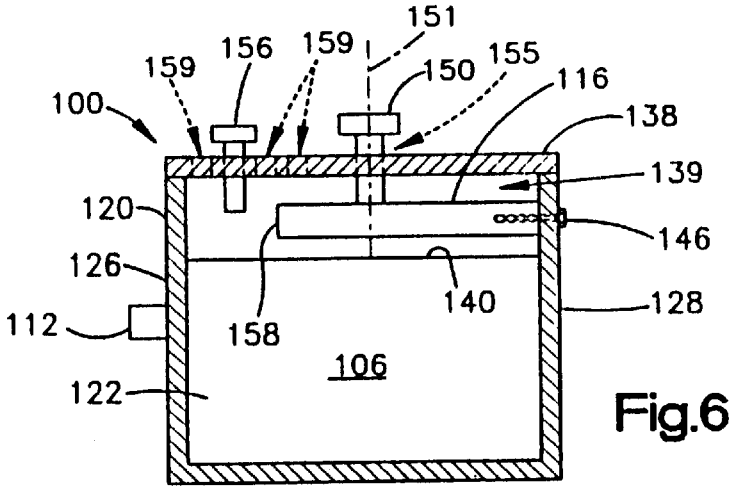
FIG. 6 is a view taken on line 6—6 of FIG. 4.

A base wall 134 of the enclosure 102 defines the bottom of each cavity 104 and 106. A removable closure wall 138 covers the cavities 104 and 106. The inner wall structure 122 in the first embodiment consists of a single inner wall 122 which, as shown in FIGS. 5 and 6, is substantially shorter than the outer walls 128–132. A gap 139 is thus defined between the closure wall 138 and an upper edge surface 140 of the inner wall 122 when the closure wall 138 is received and fastened in its closed position, as shown in the drawings.

The resonators 108 are mounted on supports 142 and 144 which, in turn, are mounted on the base wall 134. The resonators 108 and 110 are preferably made of a dielectric or metallic material, and the supports 142 and 144 are preferably made of quartz. However, any other suitable resonators and supports may be used in place of the resonators 108 and 110 and supports 142 and 144 used in the first embodiment.

The coupling structure 116 in the first embodiment is an electrically-conductive material, preferably a rigid aluminum bar with a rectangular cross section. As shown in FIGS. 4 and 6, the coupling structure 116 is attached at one end to the rear wall 128 of the enclosure 100, and projects longitudinally from the rear wall 128 over the upper edge surface 140 of the inner wall 122. More specifically, the coupling structure 116 and the upper edge surface 140 are elongated in the directions that are parallel to each other, and the coupling structure 116 is located in the gap 139 directly above the upper edge surface 140 in spaced relationship thereto and to the closure wall 138 as shown in FIGS. 5 and 6. The coupling structure also is located transversely between the two cavities 104 and 106 and the two resonators 108 and 100 uniformly along its length. Any suitable fastening structure, such as a pair of machine screws 146, may be used to support the coupling structure 116 on the rear wall 128 in this position.

As shown in FIG. 5, two coarse tuning screws 150 are mounted on the closure wall 138. When the closure wall 138 is in the closed position, the coarse tuning screws 150 are centered on the central axes 151 and 153 of the resonators 108 and 110. The coarse tuning screws 150 are received through screw-threaded apertures 155 in the closure wall 138, and are movable longitudinally toward and away from the resonators 108 and 110 upon being rotated in the apertures 155. This enables coarse tuning of the filter 100 to obtain a frequency response approximately or substantially equal to a specified response.

Figure 7:
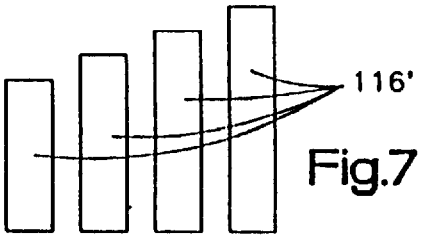
FIG. 7 is a top view of various coupling structures that can be used with the first embodiment of the invention.

A fine tuning screw 156 is similarly mounted on the closure wall 138 at a location between the front wall 126 and a free end 158 of the coupling structure 116. Fine tuning of the filter 100 is performed by moving the fine tuning screw 156 longitudinally, and further by shifting the fine tuning screw 156 selectively between a plurality of screw-threaded apertures 159 that extend in a row partially across the closure wall 138 above the gap 139. When the fine tuning screw 156 has been placed relative to the coupling structure 116 in this manner, it defines an effective length of the coupling structure 116 along the gap 139 so that the specified frequency response of the filter 100 can be achieved more closely. Moreover, the particular coupling structure 116 shown in FIGS. 4–6 is a selected one of a plurality of coupling structures 116' (FIG. 7) of differing sizes, each of which is designed to provide a correspondingly different coupling of the resonators 108 and 110 in the cavities 104 and 106. Accordingly, the filter 100 in the first embodiment of the invention can be tuned by varying both the actual length and the effective length of the coupling structure 116.

In use, a microwave frequency electromagnetic wave is received at the input device 112. The wave is transmitted from the input device 112 to the first resonator 108, and further from the first resonator 108 to the second resonator 110 through the coupling structure 116. The wave is than transmitted from the filter 100 by the output device 114, which is coupled to the second resonator 110. The input and output devices 112 and 114, the cavities 104 and 106, the resonators 108 and 110, and the coupling structure 116 are configured and tuned, as described above, to allow a predetermined passband of the received wave to pass through the filter 100.

In accordance with a particular feature with the present invention a thermal path is formed by the connection between the coupling structure 116 and the rear wall 128 of the enclosure 120. This thermal path dissipates heat generated during use of the filter 100. Additionally, since the coupling structure 1 16 is rigidly connected directly to the rear wall 128, rather than being connected indirectly to the enclosure 102 through an adjusting device or the like, the filter 100 can withstand relatively greater mechanical loads without displacement or deflection of the coupling structure 116.

Figure 8:
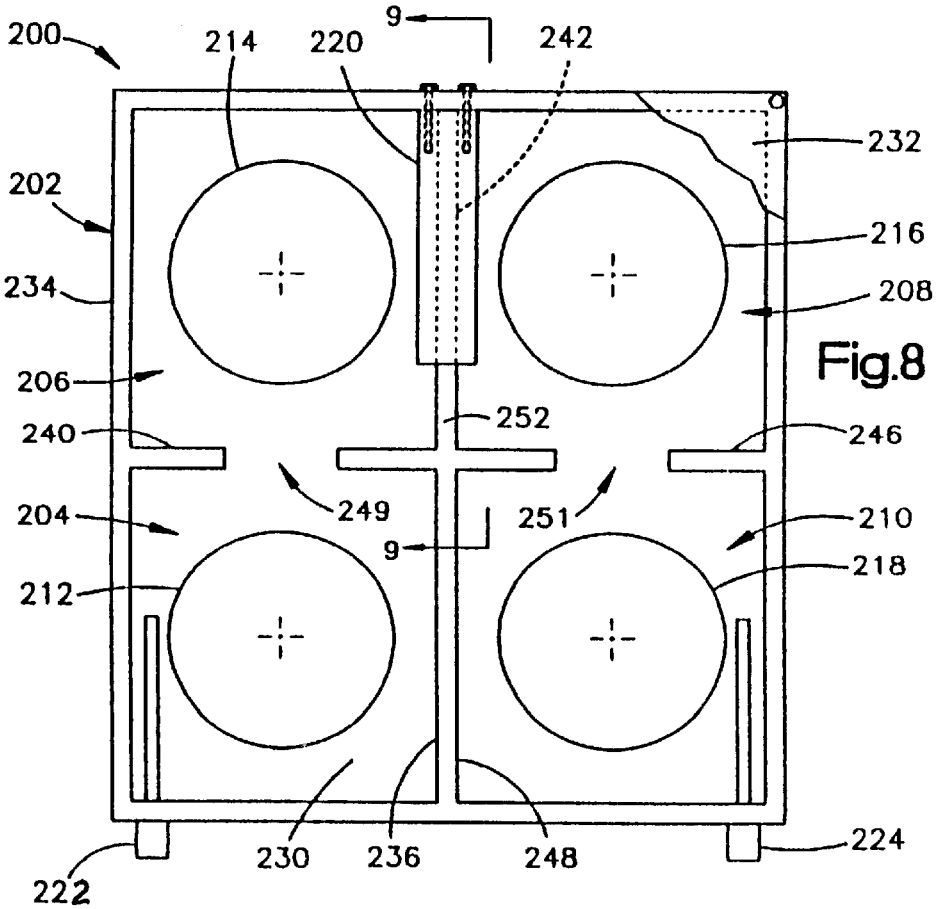
FIG. 8 is a top view of parts of a filter comprising a second embodiment of the invention.

A second embodiment of the present invention is shown in FIG. 8. The second embodiment also is a microwave resonator filter 200 including an enclosure 202. The enclosure 202 defines a rectangular array of first, second, third and fourth cavities 204, 206, 208 and 210. The first through fourth cavities 204–210 contain first through fourth resonators 212–218, respectively. In accordance with the invention, the enclosure 202 and a coupling structure 220 are both configured to couple the resonators 212–218 in series for filtering of an electromagnetic wave between an input device 222 and an output device 224.

As shown in FIG. 8, a base wall 230 of the enclosure 202 defines the bottom of each cavity 204–210. A removable closure wall 232 covers the cavities 204–210. The enclosure 202 further includes a peripheral outer wall structure 234 surrounding the cavities 204–210, and an inner wall structure 236 separating the cavities 204–210.

Figure 9:
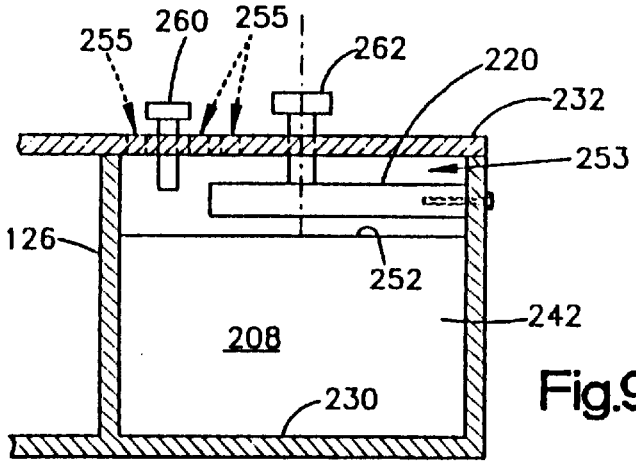
FIG. 9 is a view taken on line 9—9 of FIG. 8.

The inner wall structure 236 in this embodiment of the invention includes first, second, third and fourth inner walls 240, 242, 246 and 248. The first inner wall 240 is discontinuous across a gap 249, and thus defines a coupling device which couples the resonators 212 and 214 in the first and second cavities 204 and 206. The third inner wall 246 is likewise discontinuous across a gap 251 to define a coupling device which couples the resonators 216 and 218 in the third and fourth cavities 208 and 210. Another gap 253 (FIG. 9) is defined between the closure wall 232 and an upper edge surface 252 of the third inner wall 242. The coupling structure 220, which is substantially the same as the coupling structure 116 described above, projects longitudinally from the outer wall structure 234 directly over the upper edge surface 252 in the gap 253, and is spaced from both the closure wall 232 and the upper edge surface 252 as shown in FIG. 9. The coupling structure 220 also is spaced transversely from the second and third resonators 214 and 216 uniformly along its length. The coupling structure 220 thus is located between the second and third cavities 206 and 208 to couple the second and third resonators 214 and 216 in accordance with the invention.

Figure 10:
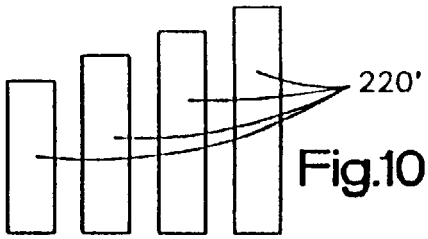
FIG. 10 is a view of various coupling structures that can be used with the second embodiment of the invention.

As in the first embodiment, the closure wall 232 in the second embodiment has a plurality of apertures 255 (FIG. 9) in a row aligned with the coupling structure 220. Fine tuning of the filter 200 can be performed by movement of a fine tuning screw 260 in and between those apertures 255 in the same manner as described above with reference to the fine tuning screw 156 in the filter 100. The filter 200 in the second embodiment further includes four coarse tuning screws 262, one of which is shown in FIG. 9, in coaxial alignment with the four resonators 212–218 for coarse tuning of the filter 200. Moreover, the coupling structure 220 in the second embodiment is preferably selected from a plurality of coupling structures 220' (FIG. 10) of differing sizes, just as the coupling structure 116 in the first embodiment is selected from a similar plurality of differing coupling structures 116'.

The present invention has been described with reference to preferred embodiments. Improvements, changes and modifications may be contemplated by those skilled in the art as taught by the foregoing description. Such improvements, changes and modifications are intended to be covered by the appended claims.

We claim:

1. A filter apparatus comprising:

an enclosure defining a plurality of cavities, each cavity having a resonator mounted therein;

said enclosure including a peripheral outer wall extending between a base and a closure, and an inner wall structure extending between said cavities;

said inner wall structure including an inner wall extending upwardly from said base between a pair of said cavities and having an inner wall upper edge surface that is spaced below said closure to define a gap between said closure and said inner wall upper edge surface;

an elongated coupling structure extending into said gap from said peripheral wall parallel to said inner wall and in spaced relationship to both said closure and said inner wall upper edge surface; and said elongated coupling structure being spaced uniformly along its length from each of the resonators in said pair of cavities between which said inner wall extends.

2. A filter apparatus as defined in claim 1 wherein said elongated coupling structure comprises a rigid bar with a rectangular cross section.

3. A filter apparatus comprising:

an enclosure defining a plurality of cavities, said enclosure including a base, a closure, an outer wall structure surrounding said cavities and an inner wall structure separating said cavities;

a corresponding plurality of resonators located in said cavities; and an elongated coupling structure independent of and separate from said inner wall structure projecting longitudinally inwardly from said outer wall structure at a location between two of said resonators and between said closure and said inner wall structure in spaced relationship to both said closure and said inner wall structure.

4. A filter apparatus as defined in claim 3 wherein said elongated coupling structure comprises a bar with a rectangular cross section.

5. A filter apparatus as defined in claim 3 wherein said elongated coupling structure is selected from a plurality of elongated coupling structures of differing sizes, each of which is configured to selectively establish a predetermined coupling between said two of said resonators.

6. A filter apparatus as defined in claim 3 wherein said inner wall structure has an upper edge surface extending along said inner wall structure and located between said two of said resonators, said elongated coupling structure being positioned between said closure and said upper edge surface in spaced relationship to both said closure and said upper edge surface, and said elongated coupling structure and said upper edge surface being elongated and parallel to one another in the direction in which said elongated coupling structure extends inwardly of said enclosure from said outer peripheral wall.

7. A filter apparatus comprising:

an enclosure having an outer wall structure, an inner wall structure, and a base wall structure which together define a plurality of cavities, said inner wall structure including an inner wall having an upper edge surface;

a corresponding plurality of resonators located in said cavities;

a closure wall structure configured to cover said cavities when said closure wall structure is in a closed position; and a coupling structure located between two of said resonators, said coupling structure further being located between said upper edge surface and said closure wall structure in spaced relationship to both said closure wall structure and said upper edge surface when said closure wall structure is in said closed position;

said coupling structure and said upper edge surface being elongated and parallel in a direction extending along the length of said inner wall that has said upper edge surface thereon.

8. A filter apparatus as defined in claim 7 wherein said coupling structure comprises a rigid bar with a rectangular cross section.

9. A filter apparatus as defined in claim 8 wherein said bar has a bar end portion attached directly to said outer wall structure and projects inwardly of said enclosure from said outer wall structure.

10. A filter apparatus as defined in claim 7 further comprising tuning screws mounted on said closure wall structure, said tuning screws including a plurality of coarse tuning screws, each of which is located above a corresponding one of said resonators when said closure wall structure is in said closed position, said tuning screws further including at least one fine tuning screw which is located on said closure wall structure adjacent to said coupling structure when said closure wall structure is in said closed position.

11. A filter apparatus as defined in claim 10 wherein said closure wall structure includes a plurality of apertures spaced-apart in a direction along the length of said coupling structure and configured to receive said fine tuning screw.

12. A filter apparatus comprising:

a wall structure including first through fourth outer walls, a closure wall, a base wall, and first through fourth inner walls, at least one of said inner walls having an upper edge surface, said walls together defining first through fourth cavities in corners of a rectangular array of cavities;

first through fourth resonators respectively located in said first through fourth cavities;

an input device operative to receive an electromagnetic wave, said input device being mounted on said first outer wall such that said input device is coupled to said first resonator;

an output device operative to transmit said electromagnetic wave, said output device being mounted on said first outer wall such that output device is coupled to said fourth resonator; and first and second coupling devices and an elongated coupling structure arranged to transmit said electromagnetic wave from said first cavity to said fourth cavity through said second and third cavities;

said coupling structure being located between two of said resonators, and between said upper edge surface and said closure wall, in spaced relationship to both said upper edge surface and said closure wall when said closure wall is in a closed position; and said coupling structure and said upper edge surface being elongated and parallel in a direction extending along the length of said inner wall that has said upper edge surface thereon.

13. A filter apparatus as defined in claim 12 wherein said coupling structure comprises a rigid bar with a rectangular cross section.

14. A filter apparatus as defined in claim 13 wherein said coupling structure is selected from a plurality of elongated coupling structures of differing sizes, each of which is configured to selectively establish a predetermined coupling between said two of said resonators.

15. A filter apparatus comprising:

an enclosure having base and closure walls, an outer peripheral wall and an inner wall;

a pair of resonator cavities on opposite sides of said inner wall;

said inner wall having an edge surface facing toward and spaced from one of said base and closure walls to define a gap therebetween; and an elongated coupling bar attached to said outer peripheral wall and extending into said gap parallel to said inner wall in spaced relationship to said inner wall edge surface and to said one of said base and closure walls.

16. The filter of claim 15 including an adjustable tuning screw adjustably extending through said one of said base and closure walls in alignment with said elongated coupling bar.

17. The filter of claim 15 wherein said inner wall extends upwardly from said base wall and inwardly from said peripheral wall, and said one of said base and closure walls is said closure wall.

18. A filter apparatus comprising:

an enclosure having a pair of resonators mounted therein in adjacent resonator cavities;

said enclosure having an outer peripheral wall, a base wall, an inner wall and a closure wall, said inner wall being between said resonator cavities and having an upper edge surface spaced from said closure wall to define a gap therebetween;

an elongated coupling bar attached to said peripheral wall and extending inwardly therefrom into said gap and between said resonators in spaced relationship to both said upper edge surface and said closure wall; and an adjustable tuning screw adjustably extending through said closure wall in alignment with said elongated coupling bar.

19. The filter of claim 18 wherein said elongated coupling bar is midway between said resonators and is uniformily spaced along its length from each of said resonators.

* * * * *